US011079206B2

(12) United States Patent
Pinoteau

(10) Patent No.: US 11,079,206 B2
(45) Date of Patent: Aug. 3, 2021

(54) PROJECTILE COMPRISING A DEVICE FOR DEPLOYING A WING OR FIN

(71) Applicant: NEXTER MUNITIONS, Versailles (FR)

(72) Inventor: Sylvain Pinoteau, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 332 days.

(21) Appl. No.: 16/318,600

(22) PCT Filed: Jul. 18, 2017

(86) PCT No.: PCT/EP2017/068092
§ 371 (c)(1),
(2) Date: Jan. 17, 2019

(87) PCT Pub. No.: WO2018/015367
PCT Pub. Date: Jan. 25, 2018

(65) Prior Publication Data

US 2019/0219373 A1 Jul. 18, 2019

(30) Foreign Application Priority Data

Jul. 18, 2016 (FR) ..... 1601109

(51) Int. Cl.
*F42B 10/14* (2006.01)
*F42B 10/02* (2006.01)

(52) U.S. Cl.
CPC ..... *F42B 10/14* (2013.01); *F42B 10/02* (2013.01)

(58) Field of Classification Search
CPC ..... F42B 10/12; F42B 10/14
See application file for complete search history.

(56) References Cited

U.S. PATENT DOCUMENTS 3,102,437 A * 9/1963 Geyer ..... G05G 17/00 475/255
4,664,339 A * 5/1987 Crossfield ..... F42B 10/14 244/3.28

(Continued)

FOREIGN PATENT DOCUMENTS

EP 0318359 A1 5/1989
EP 2354755 A1 4/2011

(Continued)

OTHER PUBLICATIONS

International Search Report and Written Opinion from corresponding International Application No. PCT/EP2017/068092, dated Jul. 18, 2017, pp. 1-12, European Patent Office, Rijswijk, The Netherlands.

*Primary Examiner* — Richard R. Green
*Assistant Examiner* — Madison Elizabeth Dittner
(74) *Attorney, Agent, or Firm* — Hauptman Ham, LLP

(57) ABSTRACT

The present invention relates to a projectile including a body having a longitudinal axis and an intermediate portion comprising a wing or fin deployment device including at least a number N, at least equal to three, of wings or fins able to be deployed, the deployment method comprising at least two phases, a first deployment phase in which each wing or fin switches from a position tangential to the body of the projectile and parallel to the longitudinal axis to a semi-deployed position, and a second deployment phase with the switching of each wing from the semi-deployed position to a deployed position in which it is perpendicular to the body of the projectile, said wing deployment device is configured to synchronize the deployment of wings or fins in the second phase.

13 Claims, 10 Drawing Sheets

(56) References Cited

U.S. PATENT DOCUMENTS

Figure 1:
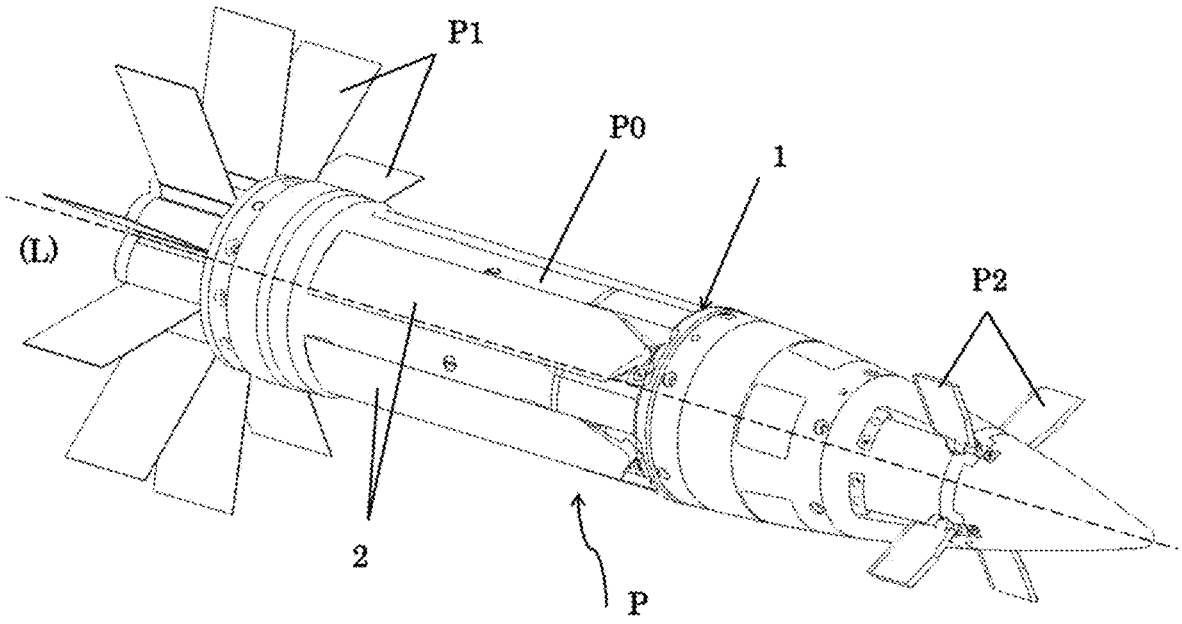

| | | | | | |
|---|---|---|---|---|---|
| 4,869,442 | A * | 9/1989 | Miller | F42B 10/14 | 244/3.28 |
| 4,964,593 | A * | 10/1990 | Kranz | F42B 10/64 | 102/208 |
| 5,125,131 | A * | 6/1992 | Leblanc | E05D 11/1007 | 16/329 |
| 5,829,715 | A * | 11/1998 | Banks | F42B 10/14 | 244/49 |
| 6,761,331 | B2 * | 7/2004 | Eisentraut | F42B 10/14 | 244/3.28 |
| 7,104,497 | B2 * | 9/2006 | Johnsson | F42B 10/16 | 244/3.29 |
| 8,921,749 | B1 | 12/2014 | Scott | | |
| 9,545,991 | B1 * | 1/2017 | Alley | B64C 3/40 | |
| 2013/0032659 | A1 | 2/2013 | Castor et al. | | |

FOREIGN PATENT DOCUMENTS

| | | | |
|---|---|---|---|
| EP | 2620738 | A1 | 7/2013 |
| WO | 02079716 | A1 | 10/2002 |

* cited by examiner

PROJECTILE COMPRISING A DEVICE FOR DEPLOYING A WING OR FIN

TECHNICAL FIELD OF THE INVENTION

The present invention relates to the field of exterior ballistics and more particularly to the stabilization of projectiles moving in space. More specifically, the invention relates to a projectile and its associated wing or fin deployment device.

TECHNOLOGICAL BACKGROUND OF THE INVENTION

During a projectile firing, several parameters are to be taken into account for said projectile to reach a designated target. During the flight phase, the projectile is subjected to aerodynamic forces that can deflect it from its trajectory. One of the important parameters is thus the stabilization of said projectile.

For their stabilization, several projectiles are, to this end, provided with wings or fins deployment mechanisms or devices. The association of such a mechanism or device with the projectile, however, should not cause a significant variation in the dimensions of the architecture of the projectile at the risk of either aggravating the aerodynamic disturbances or preventing the addition of on-board electronic devices with a view to improving, for example, the performances of the projectile.

Document U.S. Pat. No. 6,761,331 teaches a missile and a fin deployment mechanism, the arrangement of which does not reduce the useful volume of the projectile, said deployment mechanism pivots automatically by rotating a fin from a stowed orientation to a deployed orientation. The deployment mechanism comprises a spring that provides a thrust force allowing the fin to move quickly, simply and reliably from the stowed orientation to the deployed orientation. The deployment mechanism, which is carried out in three steps, also comprises one or more cam(s) or the like for guiding the fin from the stowed orientation to the deployed orientation. This mechanism therefore requires space and its complexity can cause malfunctions or incomplete deployments.

Document EP0318359 teaches a projectile with which is associated a device for deploying a fin made secured to the projectile by a hinge located at the rear of the body of the projectile, said hinge being such that the deployment movement is performed in two phases: a first phase in which the fin switches from a carrying position to a semi-deployed position, by rotation in the direction of flow and along a first axis perpendicular to the plane of the fin when the latter is in a carrying position and a second phase in which the fin switches from the semi-deployed position to the deployed position, by a rotation along a second axis which is parallel to the plane of the fin. The hinge comprises an engine acting as an actuator of the first deployment phase and as a lock of the fin assembly, hinge when the fin is in the carriage position.

The documents mentioned above have, however, drawbacks that may affect the good stabilization ensured by the fins. Indeed, the second fin deployment phase depends on the inclination of the projectile, with respect to the direction of the aerodynamic flow, in the flight phase. The aerodynamic constraints that are exerted on a fin depend on the surface presented by said fin facing the aerodynamic flow. Thus, if the projectile is inclined during the second deployment phase, the fins being each subjected to different aerodynamic forces, it is not certain that the fins are deployed correctly, thereby making unreliable the deployment mechanisms or devices taught in the documents above.

Document U.S. Pat. No. 6,761,331 teaches, moreover, fins which have, during the deployment phase, a larger surface facing the aerodynamic flow, which can induce additional constraints to a good stabilization of the projectile.

GENERAL DESCRIPTION OF THE INVENTION

The aim of the present invention is to overcome one or more drawback(s) of the prior art by proposing a projectile architecture including an effective and reliable wing or fin deployment device regardless of the trajectory of said projectile.

This objective is achieved by a projectile including a body having a longitudinal axis and an intermediate portion comprising a wing or fin deployment device including a number N, equal to at least three, of wings or fins able to be deployed, the deployment method comprising at least two phases, a first deployment phase in which each wing or fin switches from a position tangential to the body of the projectile and parallel to the longitudinal axis to a semi-deployed position, by rotation of the wing or fin around a axis perpendicular to the longitudinal axis of the projectile and a second deployment phase with the switching of each wing or fin from the semi-deployed position, in which it is still tangent to the body of the projectile, to a deployed position, in which it is perpendicular to the body of the projectile, by rotation around a axis parallel to the longitudinal axis of the projectile, said projectile being characterized in that the wing or fin deployment device is configured so that the rotation of a wing or fin around the axis parallel to the longitudinal axis of the projectile drives a toothing which meshes with a synchronizing toothed wheel which drives, by meshing, the rotation of each other wing or fin around each axis parallel to the longitudinal axis of the projectile to synchronize the deployment of the wings or fins in the second phase.

According to another feature, the wings or fins are arranged in the median position on the body of the projectile in order to improve the flight characteristics of the projectile.

According to another feature, in the first deployment phase, the wings or fins of the projectile are deployed from the rear towards the front, in the opposite direction to the aerodynamic flow, the pivot axis being mounted upstream of the wing or fin, in the direction of the aerodynamic flow when the wing or fin is in a position tangential to the body of the projectile.

According to another feature, the first phase of deployment of all the wings or fins is ensured by a single control and lock engine indirectly connected to an expansion system comprising a pressure piston and at least one compression spring, thereby lightening the mechanism in the projectile while ensuring good stabilization.

According to another feature, the pressure piston allows initiating the rotational movement of the wings in the first deployment phase and comprises guide means for guiding said piston during its translational displacement, indirectly generated by the control and lock engine, along the longitudinal axis of the projectile.

According to another feature, the device includes a body comprising on its outer part at least one housing intended to receive at least one synchronizing means and part of the wing or fin, a central chamber in which the pressure piston and at least one orientation means and at least one wing or fin synchronizing means are arranged, the central chamber being located between an upstream chamber with respect to the direction of the aerodynamic flow and called upper chamber in which the engine controlling the deployment and the lock of the wings is arranged, and a downstream chamber with respect to the direction of the aerodynamic flow and called lower chamber, the central chamber and the upper chamber being separated by an upper wall, and the central chamber and the lower chamber being separated by a lower wall.

According to another feature, the central chamber of the deployment device body also comprises at least one main column, centered on the axis of the projectile and secured to at least one of the lower or upper walls, around which a large central compression spring is wound, at least the same number N of secondary columns peripherally located around the main column and around which small compression springs are also wound, a lock disc including at least the same number N of tenons and at least one activation toothed wheel actuated by the control engine, the activation toothed wheel being connected to the lock disc so as to transmit the rotational movement thereto in order to allow the unlocking of the wings or fins.

According to another feature, the guide means comprise at least one guide disc fixed to the rear of the piston body and at least the same number N of guide rings.

According to another feature, the pressure piston also comprises at least the same number N of grooves facing the tenons of the lock disc when the latter pivots, the grooves being able to receive said tenons, at least the same number N of abutments on which rods are fixed, each rod having at its end a guide ring configured to receive a secondary column so that the small spring is located between an inner portion of the body in the vicinity of the lower wall and the ring, and at least one axial cavity centered on the axis of the projectile and configured to receive the main column and part of the large central compression spring.

According to another feature, the orientation means comprise at least the same number N of split latches, each latch including a groove able to receive a rod secured to a wing or fin comprising a tenon at its end, and at least the same number N of cams, each cam being secured to a latch.

According to another feature, the means for synchronizing the deployment of the wings comprise at least the synchronizing toothed wheel arranged in a circular groove coaxial with the central chamber, and at least the same number N of pivots equal to the number of wings, each pivot being included in the housing of the outer part of the device body and including a cavity able to receive the rod of a wing, and a pinion mounted at one of its ends, said pinion meshing with the synchronizing toothed wheel.

According to another feature, the device includes at least one fixing means for preventing the continuous rotation of at least one wing or fin around the axis of rotation of the first deployment phase once the second deployment phase is engaged.

According to another feature, the pivot is held in the housing of the outer surface of the deployment device body by a front flange located at the front end of the pivot in the direction of the upper wall and by a rear flange located at the rear end of the pivot comprising at least one pinion and in the direction of the lower wall, the flanges being provided with cylindrically-profiled grooves capping the pivot and guiding the rotational movement of said pivot.

According to another feature, the housing comprised in the outer surface of the deployment device body comprises a profile forming a V-shaped secondary housing, configured to receive part of the wing or fin at the end of the deployed phase, said deployed phase consisting of the positioning of part of the wing in said secondary housing.

DESCRIPTION OF THE ILLUSTRATIVE FIGURES

Figure 2A:
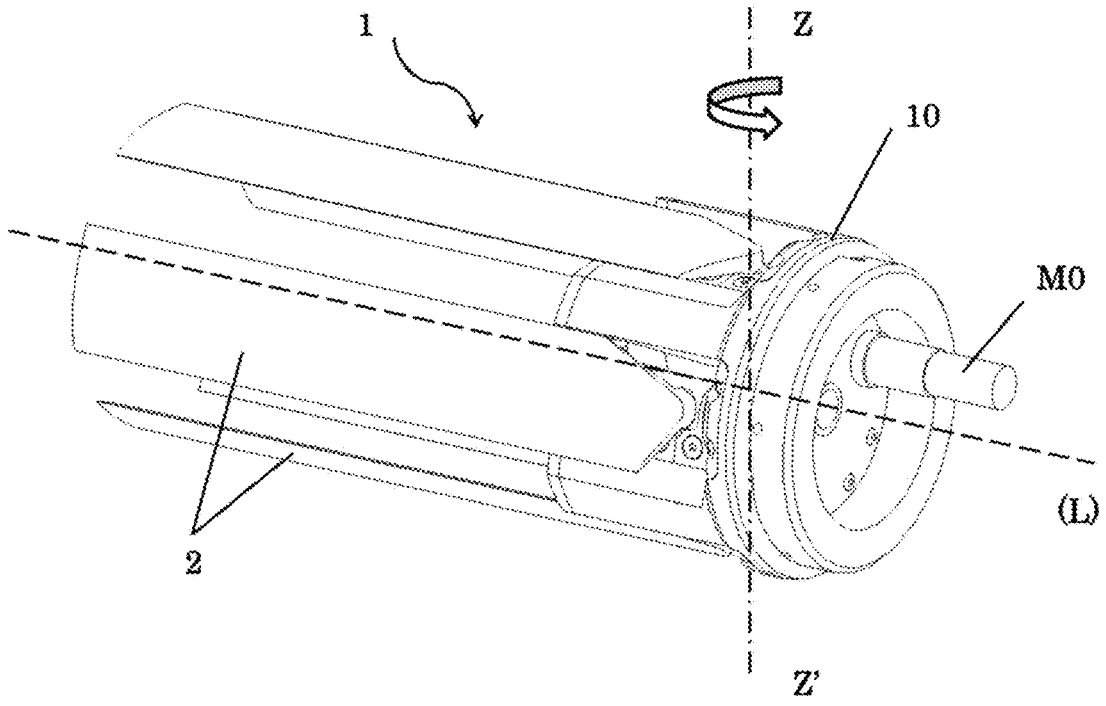
Figure 3A:
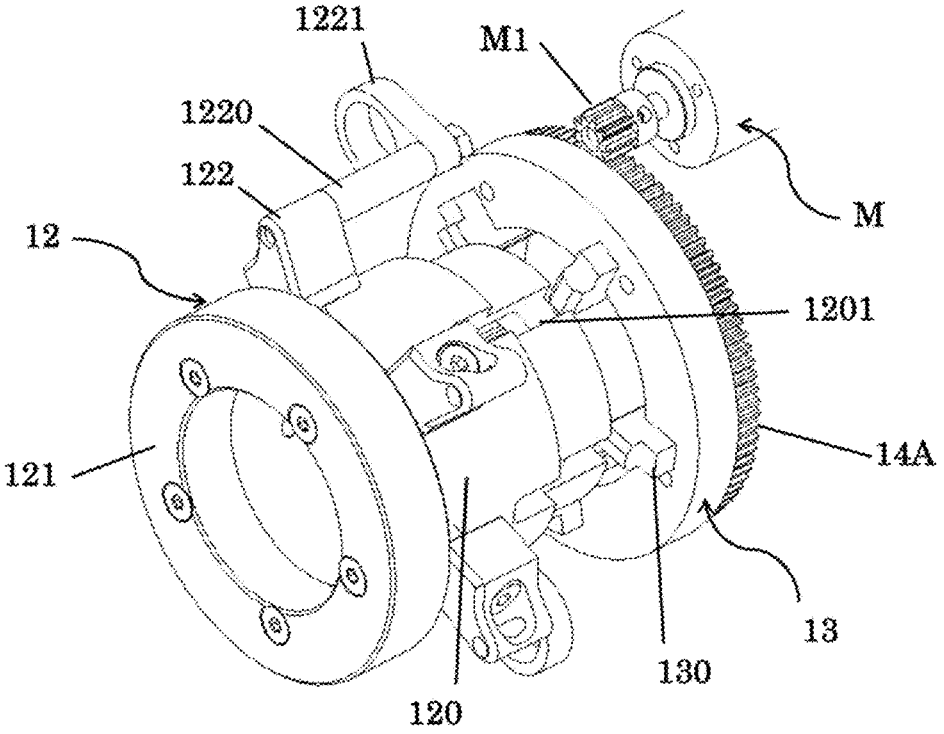
Figure 4A:
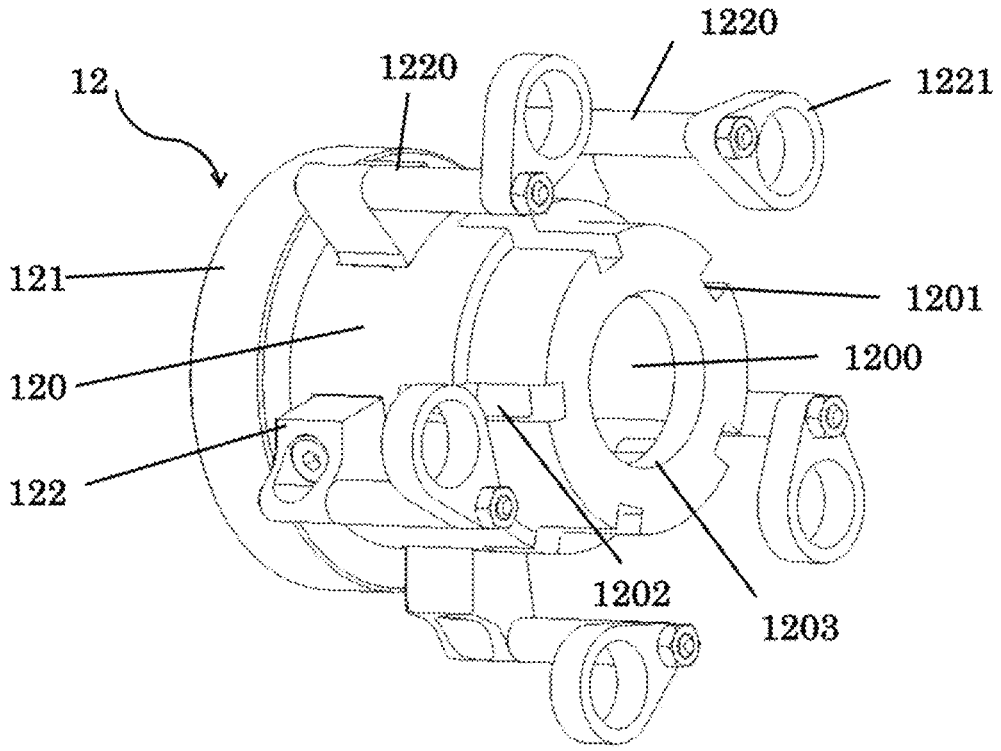
Figure 4B:
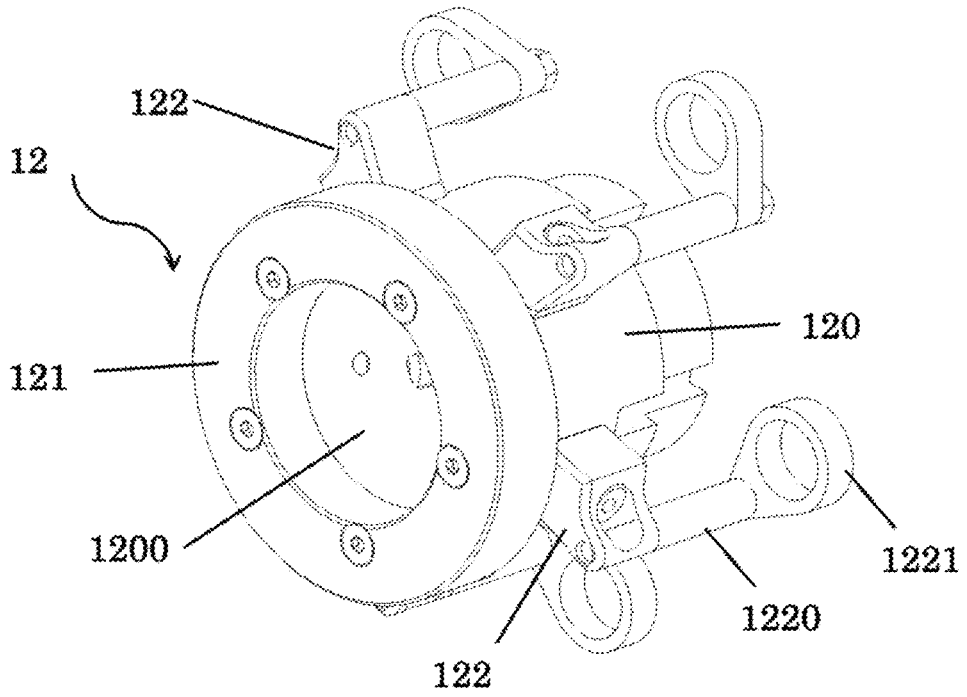
Figure 5A:
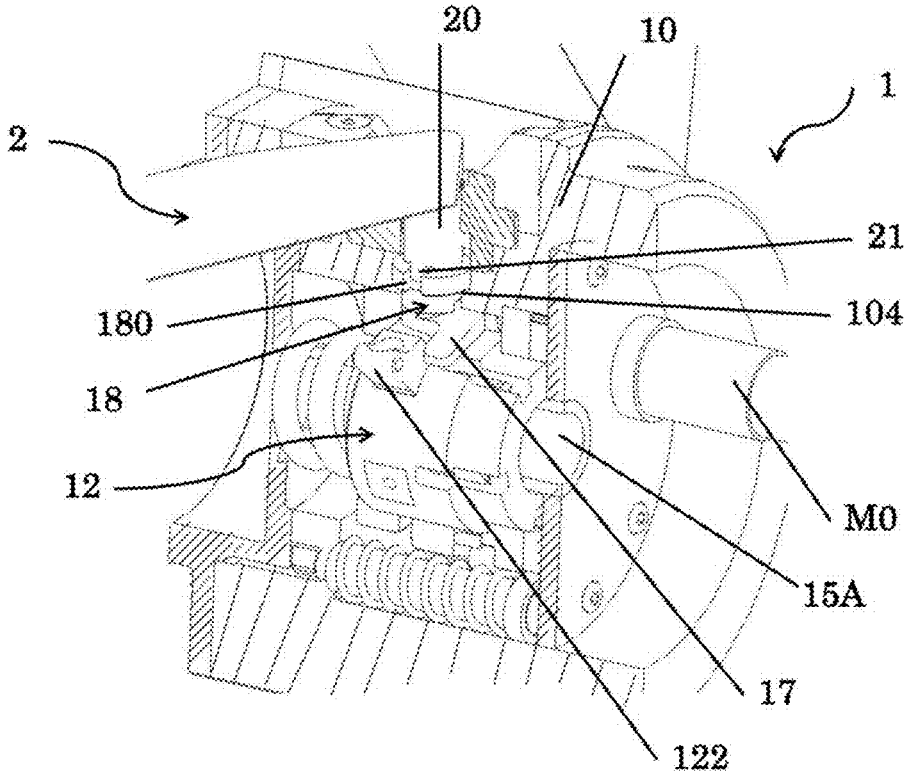
Figure 5B:
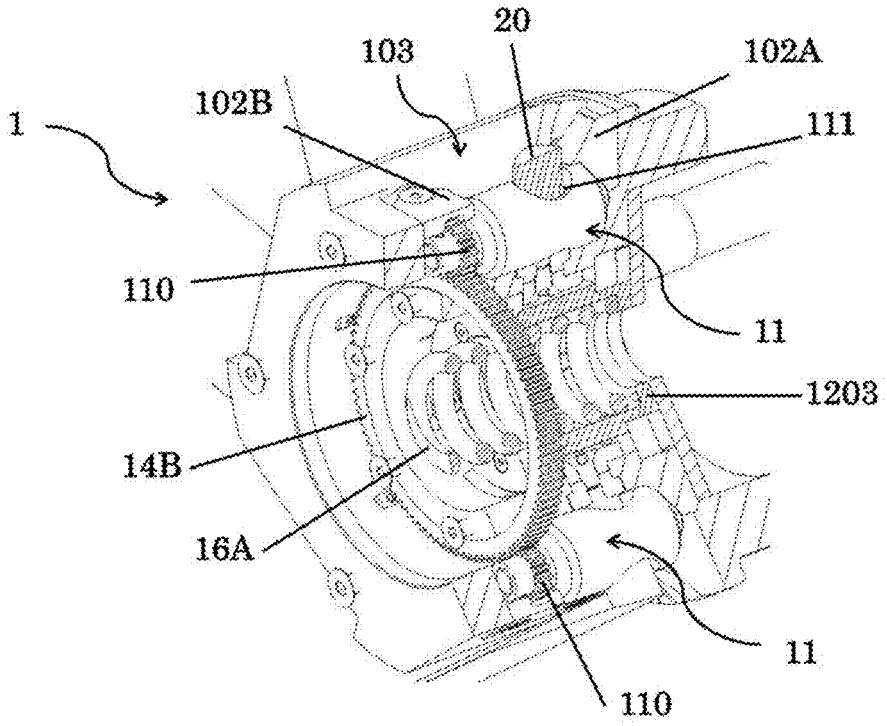
Figure 5C:
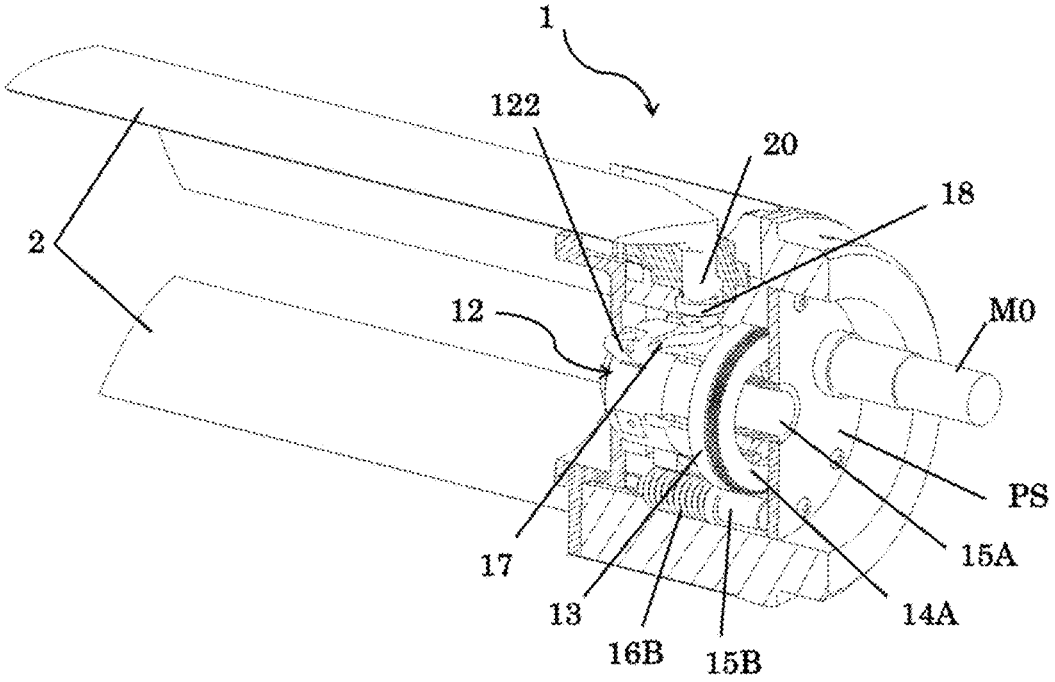
Figure 5D:
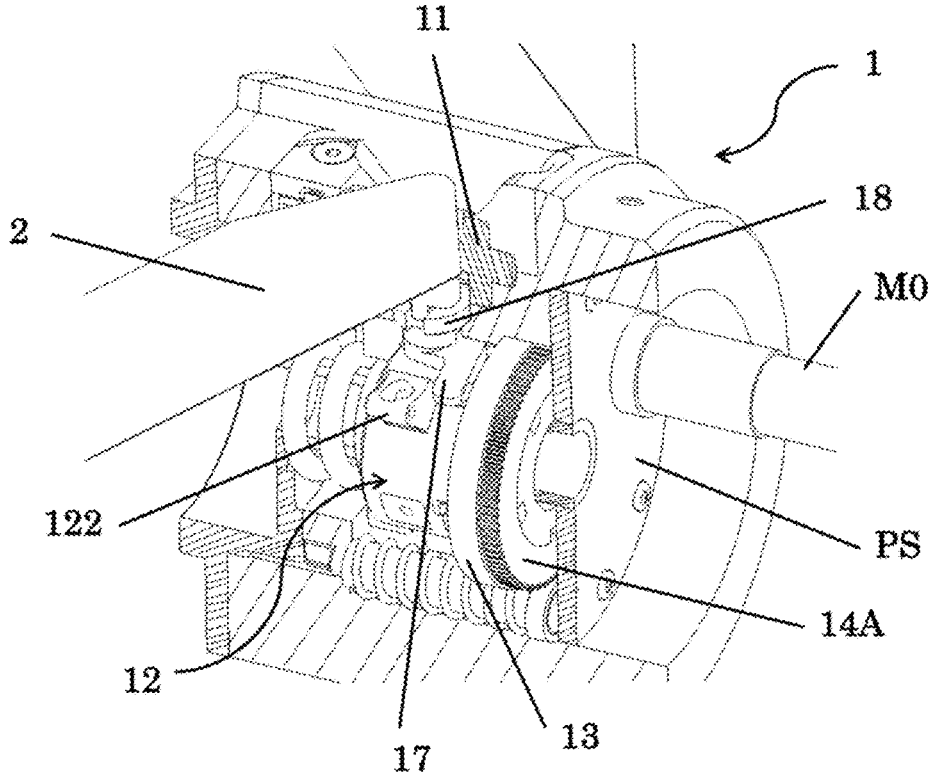
Figure 5E:
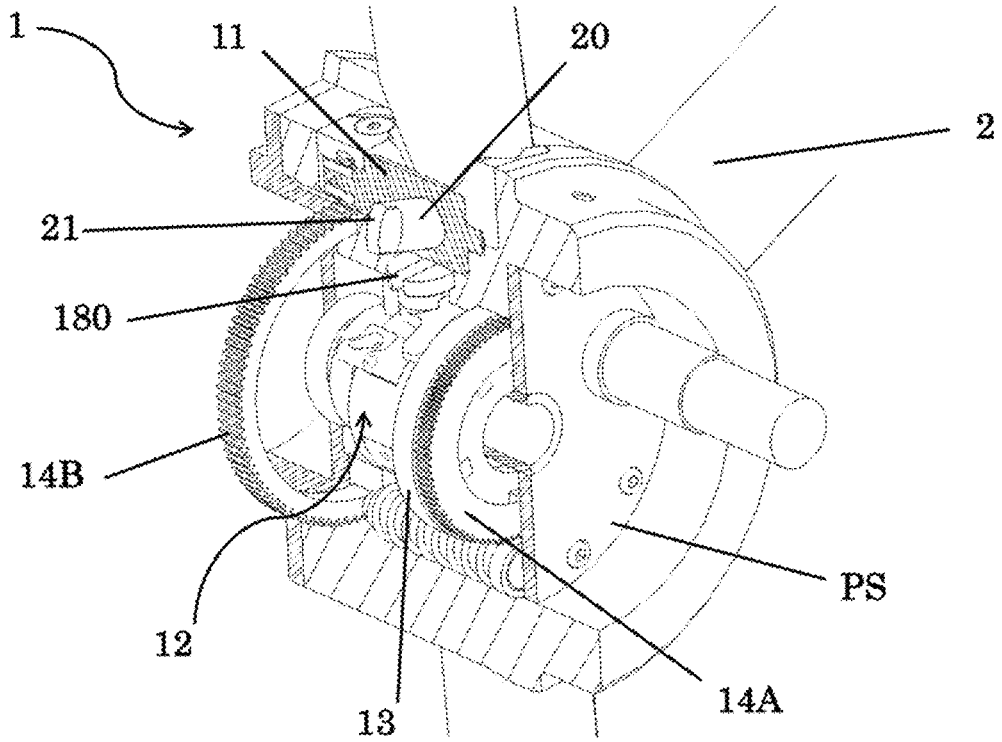
Figure 6A:
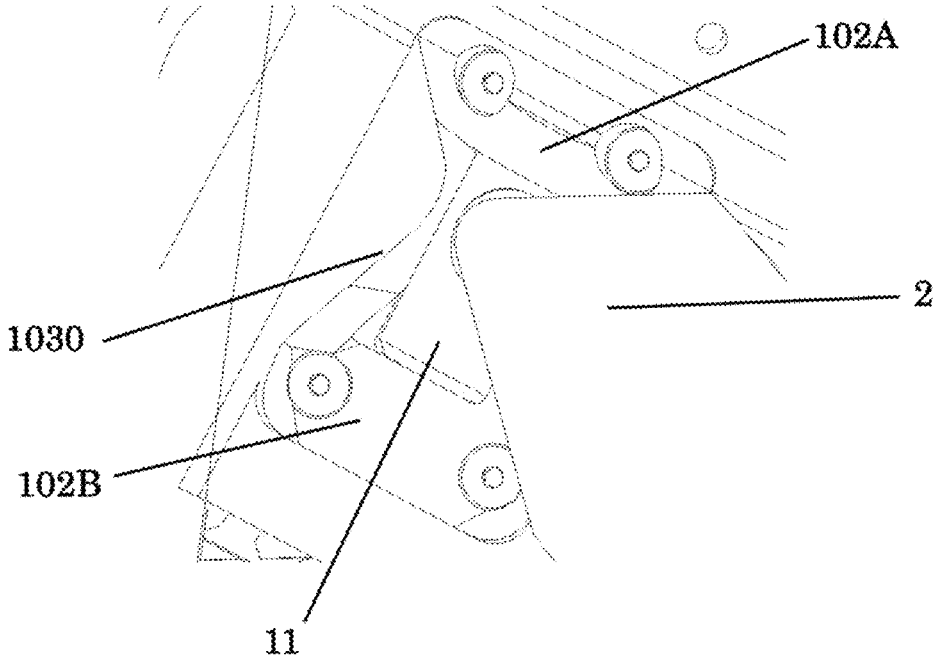
Figure 6B:
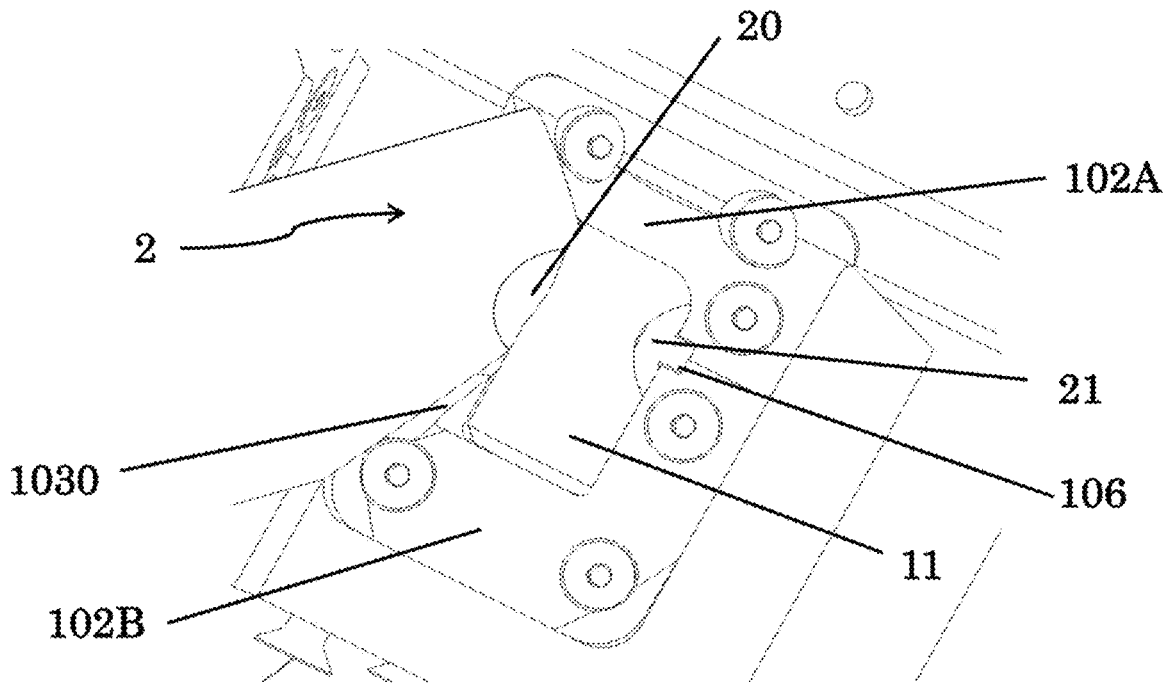

Other features and advantages of the present invention will appear more clearly upon reading the following description, with reference to the appended drawings, in which:

FIG. 1 shows a perspective view of the projectile, according to one embodiment;

FIGS. 2A; 2B and 2C show a perspective view, respectively of the deployment device before the first deployment phase, after the first deployment phase and after the second deployment phase, according to one embodiment;

FIGS. 3A; 3B, 3C and 3D show a perspective view, according to one embodiment, respectively of the control engine indirectly coupled to the pressure piston by the activation toothed wheel and the lock disc, of a section of the body of the deployment device without its elements, of a section of the body of the deployment device with the pressure piston and the compression springs before and after the first deployment phase;

FIGS. 4A and 4B show a perspective view of the pressure piston, according to one embodiment;

FIGS. 5A and 5D show a perspective view of a section of the deployment device, the wings or fins in a semi-deployed position according to one embodiment, FIGS. 5B and 5E show a perspective view of the deployment device, the wings or fins in a deployed position, according to one embodiment and FIG. 5C shows a perspective view of the section of the deployment device before the first deployment phase, according to one embodiment;

FIGS. 6A and 6B show a top view, according to one embodiment, of the part of the deployment device comprising the pivot axis of the wing or fin, respectively in a semi-deployed position and in a deployed position;

DESCRIPTION OF THE PREFERRED EMBODIMENT OF THE INVENTION

The present invention relates to a projectile (P) and to the wing or fin deployment device (1) [FIG. 1] associated therewith to ensure its stabilization in the flight phase.

In some embodiments, the projectile (P) includes a body (P0) having a longitudinal axis (L) and an intermediate portion comprising a device (1) for deploying wings (2) or fins including a number N, preferably equal to at least three, of wings (2) or fins able to be deployed, said wings being evenly distributed angularly around the axis (L) of the projectile. The deployment method comprises at least two phases, a first deployment phase in which a wing (2) or fin switches from a position tangential to the body (P0) of the projectile and parallel to the longitudinal axis (L) (FIG. 2A) to a semi-deployed position (FIG. 2B), by rotation of the wing (2) or fin around a axis (ZZ') perpendicular to the longitudinal axis (L) of the projectile (P) and a second deployment phase with the switching of the wing (2) or fin from the semi-deployed position (FIG. 2B), in which it is still tangent to the body of the projectile, to a deployed position in which it is perpendicular to the body of the projectile (FIG. 2C), by rotation around a axis (XX') parallel to the longitudinal axis (L) of the projectile (P). Said projectile (P) is characterized in that the wing (2) or fin deployment device (1) is configured so that the rotation of a wing (2) or a fin around the axis (XX') parallel to the longitudinal axis (L) of the projectile (P) drives a toothing which meshes with a synchronizing toothed wheel (14B) which drives, by meshing, the rotation of each other wing (2) or fin around each axis (XX') parallel to the longitudinal axis (L) of the projectile (P) to synchronize the deployment of the wings or fins in the second phase.

In the following description, a number of parts or members will be in a number N which is equal to the number of wings (2) or fins.

The projectile (P) is, for example and without limitation, a missile, a shell or a rocket, the body (P0) of which may comprise at least three stabilizing fins (P1) fixed at the tail of the body (P0) of said projectile (P) and/or at least three piloting fins (P2) (or canard fins) fixed on the front tip of the body (P0) of the projectile (P), as seen for example in FIG. 1, and of reduced dimensions compared to the dimensions of the fins (P1) fixed at the tail of the body (P0) of the projectile.

The deployment device (1) can be fixed on the body (P0) of the projectile (P) between the tail and the front tip of said projectile (P). Preferably, the device is fixed on the body (P0) of the projectile so that the wings (2) or fins of the device are arranged in the median position on the body of the projectile (P) in order to improve the lift characteristics ensured by the wings (2), such as for example the wings of an airplane.

The wings (2) are deployed in the vicinity of the peak of the ballistic trajectory of the projectile and their lift allows increasing the range of said projectile.

In some embodiments, in the first deployment phase, the wings (2) or fins of the projectile (P) are deployed preferably from the rear towards the front, in the opposite direction to the aerodynamic flow, the pivot axis being mounted upstream of the wing (2) or fin, in the direction of the aerodynamic flow, when the wing (2) or fin is in a position tangential to the body (P0) of the projectile (FIG. 1).

Figure 3B:
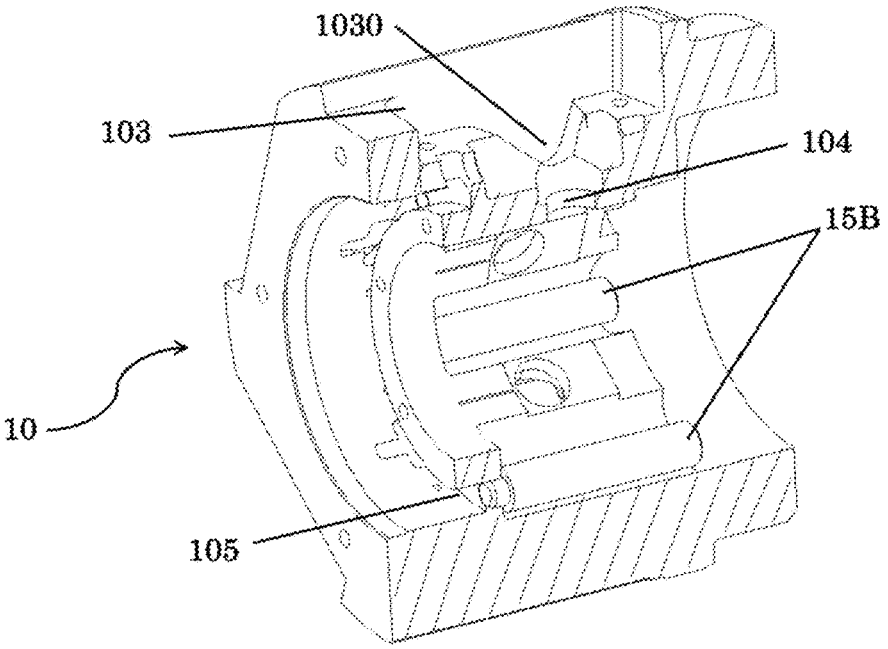
Figure 3C:
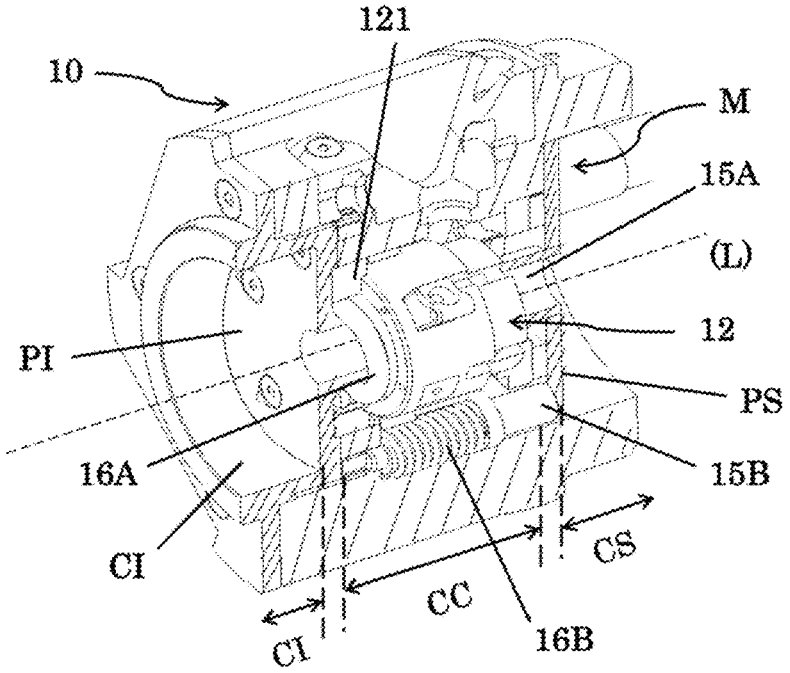
Figure 3D:
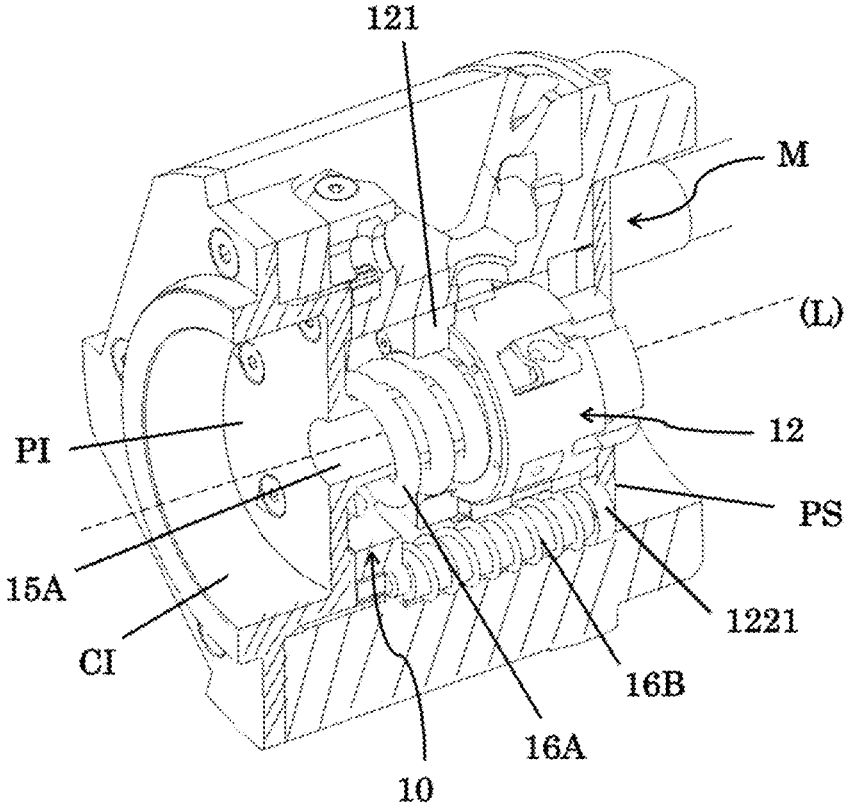

In some embodiments, the first phase of deployment of all the wings (2) or fins is ensured by a single control and lock engine (M) indirectly connected to an expansion system comprising a pressure piston (12) and at least one compression spring (16A, 16B), as seen for example in FIGS. 3A, 3C and 3D, thereby lightening the mechanism in the projectile (P) while ensuring good stabilization.

In the case where the wings or fins of the device (1) are deployed in the opposite direction to the aerodynamic flow, it is necessary to provide a force to counter the aerodynamic constraints. The pressure piston (12) and the compression springs (16A, 16B) provide this force necessary to perform the first deployment phase. In this arrangement of the wings or fins, the aerodynamic constraints act as a brake and thus reduce the risks that the first deployment phase is sudden and damages the deployment device, which can thereby lead to a destabilization of the projectile along its trajectory.

In some embodiments, the pressure piston (12) allows initiating the rotational movement of the wings (2) in the first deployment phase and comprises guide means (121, 1221) for guiding said piston (12) during its translational displacement, indirectly generated by the control and lock engine (M), along the longitudinal axis (L) of the projectile (P).

In some embodiments, the device (1) includes a body (10) (FIGS. 3B, 3C and 3D) comprising on its outer part at least one housing (103) (FIG. 3B) intended to receive at least one synchronizing means (11) [FIG. 5B] and part of the wing (2) or fin. The body (10) delimits a central chamber (CC) in which the pressure piston (12) and at least one orientation means (17, 18) (FIG. 5A) and at least one wing (2) or fin synchronizing means (14B) are arranged, the central chamber (CC) [FIG. 3C] being located between an upstream chamber with respect to the direction of the aerodynamic flow and called upper chamber (CS) in which the engine (M) controlling the deployment and the lock of the wings (2) is arranged and a downstream chamber with respect to the direction of the aerodynamic flow and called lower chamber (CI), the central chamber (CC) and the upper chamber (CS) being separated by an upper wall (PS), and the central chamber (CC) and the lower chamber (CI) being separated by a lower wall (PI) (see FIG. 3C).

Figure 2B:
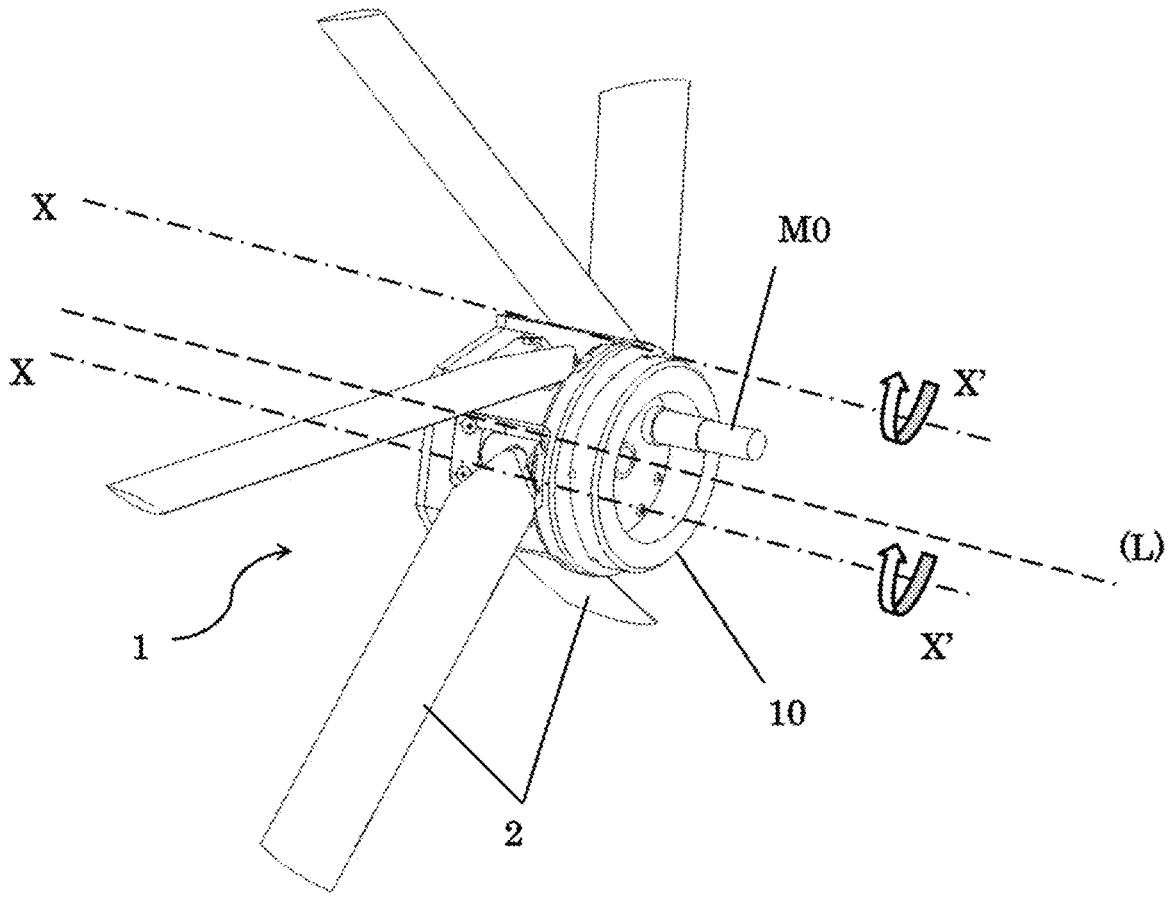
Figure 2C:
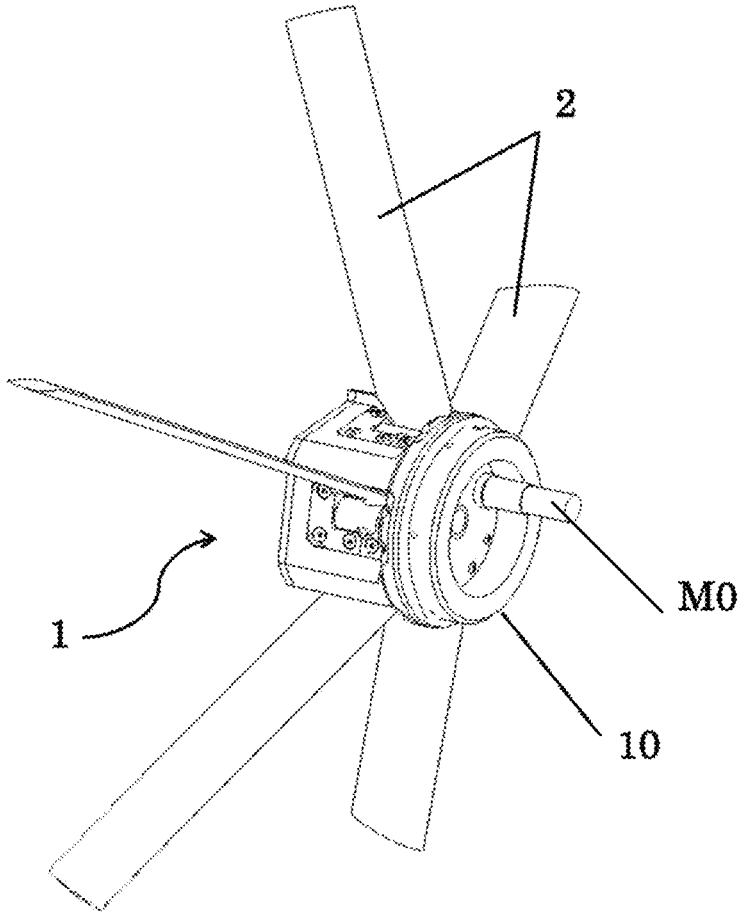

In some embodiments, the central chamber (CC) of the deployment device (1) body (10) also comprises at least one main column (15A), which is centered on the axis (L) of the projectile and here secured to the lower wall (PI) and positioned in a bore of the upper wall (PS), around which a large central compression spring (16A) is wound. Conversely, the central column could be secured to the upper wall and positioned in a bore of the lower wall. A number N of secondary columns (15B), N being equal to the number of wings (for example five, as shown in FIG. 2B), peripherally located around the main column (15A), evenly distributed angularly, and around which are also wound with small compression springs (16B), a lock disc (13) (FIG. 3A) including at least the same number N of tenons (130) as wings and at least one activation toothed wheel (14A) actuated by the control engine (M), the activation toothed wheel being connected to the lock disc (13) so as to transmit the rotational movement thereto in order to allow the unlocking of the wings (2) or fins. Part of the engine (M), located in the central chamber (CC), comprises a pinion (M1) meshing with the activation toothed wheel (14A) which, fixed to the lock disc (13), will cause the rotation of the latter. The other part (M0) of the engine (M) is located in the upper chamber (CS), the axis of the engine (M) is parallel to and at the periphery of the longitudinal axis (L) of the projectile (P).

It should be noted that, for the clarity of the partial sectional figures, some of the elements are not always represented. Particularly, it is seen in FIG. 3A, showing the pressure piston (12), that the rods (1220) fixed to the abutments (122) are not all represented. The same applies to these elements in FIGS. 3C, 3D, 5C, 5D and 5E.

In some embodiments, the guide means (121, 1221) comprise preferably at least one guide disc (121) fixed to the rear of the piston body (120) (FIGS. 4A, 4B) and at least the same number N of guide rings (1221). The disc (121) slides in a bore of the body (10) [see FIGS. 3C and 3D]. The rings (1221) slide along the secondary columns (15B) fixed to the body (10), for example by screwing.

In some embodiments, the pressure piston (12) (FIGS. 4A, 4B) also comprises at least the same number N of grooves (1201) intended to face the tenons (130) of the lock disc (13), when the latter pivots, the grooves (1201) being able to receive said tenons (130). The piston (12) comprises the same number N of abutments (122) on which rods (1220) are fixed. As seen in FIG. 4A, the grooves (1201) include slots (1202) because they open into the cavity (1200) beyond a front wall (1203) receiving the bearing of the large spring (16A).

Each rod (1220) carries at its end a guide ring (1221) which is configured to receive a secondary column (15B). Each secondary column (15B) receives a small spring (16B) which is located between an inner portion of the body (10) in the vicinity of the lower wall (PI) and the ring (1221), as represented for example in FIGS. 3C and 3D. The piston (12) includes an axial cavity (1200) centered on the axis (L) of the projectile and configured to receive the main column (15A) and part of the large central compression spring (16A) (FIG. 3C). The large spring (16A) is arranged between the lower wall (PI) and the front wall (1203) of the piston (FIGS. 4A and 5B) next to the outlet of the grooves (1201) (see FIG. 3D).

In the locked state, the large spring (16A) pushes the piston (12) in abutment against the tenons (130). When the control engine (M) is activated during the flight, the lock disc (13) is rotated. The tenons (130) are then positioned opposite the grooves (1201). This positioning of the tenons (130) allows unlocking the pressure piston (12), the body (120) of which slides along the main column and the guide rings (1221) along the secondary columns (15B), from the lower wall (PI) to the upper wall (PS) of the device (1), under the action of the compression springs. The translational displacement of the piston (12) is stopped when the end of the body of said piston (12) abuts on the upper wall (PS) of the device (1). The tenons (130) of the lock disc (13) are then abutting on surfaces comprised in the grooves of the piston (12).

The guide means (121, 1221) allow preventing the longitudinal axis of the piston (12) from oscillating around the longitudinal axis (L) of the projectile during the translational movement of said piston (12), in which case an angular offset could occur and the cams (17) would no longer face the abutments (122) of the piston. This would lead to a non-deployment or partial deployment of the wing 2, thus causing a destabilization of the projectile (P).

In some embodiments, the orientation means (17, 18) (FIGS. 5A, 5B, 5C and 5D) preferably comprise at least the same number N of split latches (18). Each latch (18) includes a groove (180) able to receive a tenon (21) located at the end of a rod (20) secured to a wing (2) or fin. Each latch (18), secured to a cam (17), is housed in a radial drill (104) of the body (10) [see FIGS. 3D and 5A, for example], an enlarged head of the latch (18) being positioned against a counterbore of this drill (104).

The tenon (21) of the rod (20) of the wing or fin is configured to be inserted into the groove (180) of the latch (18) so that the movement of the latch (18) drives that of the rod (20) and therefore of the wing (2) or fin during the first deployment phase.

In some embodiments, the wing (2) deployment synchronizing means (14B, 11) comprise preferably at least one synchronizing toothed wheel (14B) (FIGS. 5B, 5E) arranged in a circular groove (105) coaxial with the central chamber (CC) and closed by the lower wall (P1) (see FIG. 3B), and the same number N of pivots (11), equal to the number of wings (2) (FIG. 5B). Each pivot (11) is included in the housing (103) of the outer part of the device (1) body (10) and includes a cavity (111) able to receive the rod (20) of a wing (2), and a pinion (110) mounted at one of its ends, said pinion meshing with the synchronizing toothed wheel (14B) (FIG. 5B).

According to the invention, the first deployment phase results from the translational displacement of the pressure piston (12) along the longitudinal axis (L) of the projectile (P) in the direction of the upper wall (PS) separating the central (CC) and upper (CS) chambers of the device (1) body (10), this displacement causing the rotation of the cams (17) around the axes (ZZ') perpendicular to the longitudinal axis (L) of the projectile (P).

The translational movement of the piston (12) is triggered by the start of the control and lock engine (M) which rotates the lock (13) and positions the tenons (130) facing the grooves (1201) of the piston, thereby releasing the piston (12) which can move pushed by the springs (16A) and (16B). The central compression spring (16A) and small springs (16B) switch from a compressed state to an expanded state thereby causing the displacement of the pressure piston (12) towards the upper wall (PS).

As shown in FIG. 4B), the piston (12) includes N abutments (122), each being in point-bearing connection with a cam (17) [see FIGS. 5A, 5C and 5D]. The displacement of the piston (12) therefore actuates the rotation of the cams (17) (see FIG. 5D) so as to allow the switching of each wing (2) from a position tangential to the body (P0) of the projectile (P) and parallel to the longitudinal axis (L) to a semi-deployed position and tangent to the body (P0) of the projectile (P).

In the lock position, the compression springs (16B) are compressed, as shown in FIG. 3C for example, at least one abutment (122) of the pressure piston (12) being in contact with a cam (17).

The start of the engine (M) causes the unlocking of the piston (12) and compression springs (16A, 16B) which extend along the main and secondary columns (15A, 15B), allowing the piston (12) to move along the main column.

The abutment (122) of the pressure piston (12) in contact with the cam then generates the rotation thereof around a axis (ZZ') perpendicular to the longitudinal axis (L) of the projectile (P). The latch (18), connected to the cam (17) and including the end of the rod (20) of the wing (2) or fin, in turn causes the rotation of said wing or fin, switching it from a position tangential to the body (P0) of the projectile (P) and parallel to the longitudinal axis (L) to a semi-deployed position and tangent to the body (P0) of the projectile (P) (FIG. 5D).

In some embodiments, the device includes at least one fixing means for preventing the continuous rotation of at least one wing (2) or fin around the axis of rotation (ZZ') of the first deployment phase once the second deployment phase is engaged.

Thus, when the wings (2) or fins are in the semi-deployed position (FIG. 5A), each cam (17) abuts on a tenon (130) of the lock disc (13) and is thus located between an abutment (122) of the pressure piston (12) and a tenon (130) of the lock disc (13). This pinching thus prevents rotation of the cam (17) and of the latch (18) around the axis (ZZ') perpendicular to the longitudinal axis (L) of the projectile (P). The tenon (21) secured to the rod (20) being engaged in the groove (180) of the latch (18), the rod (20) of the wing (2) therefore cannot rotate around the axis (ZZ') perpendicular to the longitudinal axis (L) of the projectile (P) when the wing is in a semi-deployed position.

In some embodiments, the second deployment phase is ensured by the rotational movement, around a axis (XX') parallel to the longitudinal axis (L) of the projectile (P), of at least one pivot (11) comprised in at least one housing (103) of the outer surface of the deployment device (1) body (10). During the rotation of the wing (2) or fin around the axis (XX') parallel to the longitudinal axis (L) of the projectile (P), the tenon (21) of the rod (20) of said wing (2) or fin comes out of the groove (180) of the catch (18), as seen for example in FIG. 5E, in order to allow the wing to rotate around the axis (XX') parallel to the longitudinal axis (L) of the projectile (L).

Moreover, at least one groove (106) [FIG. 6B], machined in the body (10) of the device (1), can receive the tenon (21) of the rod (20) when said tenon (20) comes out of the groove (180) of the latch (18) during the second wing deployment phase. Such an arrangement prevents the rod (20) of the wing (2) or fin from rotating around the axis (ZZ') perpendicular to the longitudinal axis (L) of the projectile (P) during the second deployment phase.

In some embodiments, the pivot (11) is preferably held in the housing (103) of the outer surface of the deployment device (1) body (10) by a front flange (102A) located at the front end of the pivot (11) in the direction of the upper wall (PS) and by a rear flange (102B) (FIG. 5B) located at the rear end of the pivot (11) which includes at least one pinion (110) and in the direction of the lower wall (PI). The flanges (102A, 102B) are provided with cylindrically-profiled grooves which cap the pivot (11) and guide the rotational movement of the pivot (11).

The rotation of the pivot (11) causes the rotation of a drive pinion (110) or toothing of the synchronizing toothed wheel (14B). During the rotation of the pivot (11) causing the rotation of the wing (2) or fin, the pinion (110) fixed to one of the ends of the pivot (11) also rotates at the same speed as the latter. The pinion (110), being connected to the synchronizing toothed wheel (14B), will cause its rotation. The synchronizing toothed wheel (14B), by its rotation, simultaneously induces the rotation of each of the other pinions (110) with which it is connected. The rotation of each other pinion causes the rotation of the pivot (11) with which it is associated and the rotation of each other pivot allows the rotation of the wing to which it is connected, thus allowing a synchronized deployment of all the wings or fins.

In some embodiments, as shown in FIGS. 3B and 6A, the housing (103) comprised in the outer surface of the deployment device (1) body (10) comprises a profile forming a V-shaped secondary housing (1030). This secondary housing (1030) is configured to receive part of the wing (2) or fin at the end of the deployed phase, when part of the wing (2) is positioned in said secondary housing (1030).

During its rotation around the axis (XX') parallel to the longitudinal axis (L) of the projectile (P) in the second deployment phase, the wing (2) or fin therefore switches from a position tangential to the body (P0) of the projectile (P) to a position perpendicular to the body (P0) of the projectile (P). Part of the wing (2) or fin then abuts against the wall of the V-shaped secondary housing (1030), so as to hold the position of the wing (2) or fin fixed in the deployed phase (FIG. 6B).

In some embodiments, the movement in the second deployment phase is activated by the resultant of the aerodynamic forces exerted on the wings (2) in the semi-deployed position.

The present application describes various technical features and advantages with reference to the figures and/or various embodiments. Those skilled in the art will understand that the technical features of a given embodiment can in fact be combined with features of another embodiment unless explicitly stated otherwise, or unless the combination does not provide a solution to at least one of the technical problems mentioned in the present application. In addition, the technical features described in a given embodiment can be isolated from the other technical features of this embodiment unless explicitly stated otherwise.

It must be obvious to those skilled in the art that the present invention allows embodiments in many specific forms without departing from the field of application of the invention as claimed. Consequently, the present embodiments must be considered as illustrations, but can be modified in the area defined by the scope of the appended claims, and the invention must not be limited to the details given above.

The invention claimed is:

1. A projectile (P) including a body (P0) having a longitudinal axis (L) and an intermediate portion comprising a device (1) for deploying wings or fins including a number N, equal to at least three, of wings (2) or fins able to be deployed, the device (1) being configured to deploy the wings (2) or fins from a retracted position to a semi-deployed position and from the semi-deployed position to a deployed position, wherein each wing (2) or fin is rotatable, during a phase called first deployment phase, around an axis (ZZ') perpendicular to the longitudinal axis (L) of the projectile (P) from the retracted position wherein the wings (2) or fins are tangential to the body (P0) of the projectile and parallel to the longitudinal axis (L) to the semi-deployed position, and each wing (2) or fin is rotatable, during a phase called second deployment phase, around an axis (XX') parallel to the longitudinal axis (L) of the projectile (P) from the semi-deployed position, in which the wing or fin is still tangent to the body of the projectile, to a deployed position in which the wing (2) or fin is perpendicular to the body of the projectile, wherein the wing (2) or fin deployment device (1) is configured so that the rotation of a wing (2) or fin around the axis (XX') parallel to the longitudinal axis (L) of the projectile (P) drives a toothing which meshes with a synchronizing toothed wheel (14B) which drives, by meshing, the rotation of each other wing (2) or fin around each axis (XX') parallel to the longitudinal axis (L) to synchronize the deployment of the wings or fins in the second phase, and wherein the wing (2) or fin deployment device (1) comprises at least a single control and locking engine (M) controlling the first phase of deployment of all the wings (2) or fins and at least a pressure piston (12) including a guide arrangement (121, 1221) for guiding the piston (12) during a translational displacement of the piston (12) along the longitudinal axis (L) of the projectile (P), the translational displacement initiating rotational movement of the wings (2) or fin in the first deployment phase, the translational displacement being indirectly generated by the single control and locking engine (M), which activation rotates a locking disc (13) in contact with the pressure piston (12), thereby releasing the pressure piston (12) and allowing the translational displacement.

2. The projectile (P) according to claim 1, wherein the wings (2) or fins are arranged in a median position on the body of the projectile (P) in order to improve flight characteristics of the projectile (P).

3. The projectile (P) according to claim 1, wherein the device further comprises at least a pivot axis located upstream of the wing or fin in a direction opposite to a direction of flight of the projectile (P) and wherein the wing (2) or fin is in the position tangential to the body (P0) of the projectile in such a way that, in the first deployment phase, the wings (2) or fins of the projectile (P) are deployed from a rear of the projectile (P) towards a front of the projectile (P), in the direction of flight of the Projectile (P).

4. The projectile (P) according to claim 1, wherein the single control and locking engine (M) controlling the first phase of deployment of all the wings (2) or fins, is indirectly connected to an expansion system comprising the pressure piston (12) and at least a compression spring (16A, 16B), thereby lightening a deployment mechanism in the projectile (P) while ensuring good stabilization.

5. The projectile (P) according to claim 4, wherein the device (1) further includes a body (10) comprising on its outer part at least one housing (103) intended to receive at least one synchronizing means (11) and part of the wing (2) or fin, a central chamber (CC) in which the pressure piston (12) and at least one orientation means (17, 18), and a wing (2) or fin synchronizing toothed wheel (14B) are arranged, the central chamber (CC) being located between an upstream chamber with respect to the direction of aerodynamic flow and called upper chamber (CS) in which the engine (M) controlling the deployment and the locking of the wings (2) or fins is arranged and a downstream chamber with respect to the direction of aerodynamic flow and called lower chamber (CI), the central chamber (CC) and the upper chamber (CS) being separated by an upper wall (PS), and the central chamber (CC) and the lower chamber (CI) being separated by a lower wall (PI).

6. The projectile (P) according to claim 5, wherein the central chamber (CC) of the deployment device (1) body (10) also comprises at least one main column (15A), centered on the longitudinal axis (L) of the projectile and secured to at least one of the lower (PI) or upper (PS) walls, around which a large central compression spring (16A) is wound, at least the same number N of secondary columns (15B) peripherally located around the main column (15A) and around which small compression springs (16B) are also wound, a locking disc (13) including at least the same number N of tenons (130) and at least one activation toothed wheel (14A) actuated by the control engine (M), the activation toothed wheel being connected to the locking disc (13) so as to transmit rotational movement thereto in order to allow unlocking of the wings (2).

7. The projectile (P) according to claim 6, wherein the pressure piston (12) allows initiating rotational movement of the wings (2) in the first deployment phase and comprises guide means (121, 1221) for guiding said piston (12) during its translational displacement, indirectly generated by the control and lock engine (M), along the longitudinal axis (L) of the projectile (P), wherein the guide means (121, 1221) comprise at least one guide disc (121) fixed to the rear of the piston (12) body (120) and at least the same number N of guide rings (1221), wherein the pressure piston (12) further comprises at least the same number N of grooves (1201) facing the tenons (130) of the locking disc (13) when the latter pivots, the grooves (1201) being able to receive said tenons (130), at least the same number N of abutments (122) on which rods (1220) are fixed, each rod (1220) having at its end a guide ring (1221) configured to receive a secondary column (15B) so that the small spring (16B) is located between an inner portion of the body (10) in the vicinity of the lower wall (PI) and the ring (1221), and at least one axial cavity (1200) centered on the longitudinal axis (L) of the projectile and configured to receive the main column (15A) and part of the large central compression spring (16A).

8. The projectile (P) according to claim 5, wherein the orientation means (17, 18) comprise at least the same number N of split latches (18), each latch including a groove (180) able to receive a rod (20) secured to a wing (2) or fin comprising a tenon (21) at its end, and at least the same number of cams (17), each cam (17) being secured to a latch (18).

9. The projectile (P) according to claim 5, wherein the means (14B, 11) for synchronizing the deployment of the wings (2) comprise the synchronizing toothed wheel (14B) arranged in a circular groove (105) coaxial with the central chamber (CC), and the same number N of pivots (11) equal to the number of wings (2), each pivot (11) being included in the housing (103) of the outer part of the device (1) body (10) and including a cavity (111) able to receive a rod (20) secured to a wing (2) or fin, and a pinion (110) mounted at one of its ends, said pinion meshing with the synchronizing toothed wheel (14B).

10. The projectile (P) according to claim 5, wherein the pivot (11) is held in the housing (103) of an outer surface of the deployment device (1) body (10) by a front flange (102A) located at the front end of the pivot (11) in the direction of the upper wall (PS) and by a rear flange (102B) located at the rear end of the pivot (11) comprising at least one pinion (110) and in the direction of the lower wall (PI), the flanges (102A, 102B) being provided with cylindrically-profiled grooves capping the pivot (11) and guiding rotational movement of said pivot (11).

11. The projectile (P) according to claim 5, wherein the housing (103) comprised in an outer surface of the deployment device (1) body (10) comprises a profile forming a V-shaped secondary housing (1030), configured to receive part of the wing (2) or fin at the end of the deployed phase, said deployed phase consisting of the positioning of part of the wing (2) in said secondary housing (1030).

12. The projectile (P) according to claim 1, wherein the guide means (121, 1221) comprise at least a guide disc (121) fixed to the rear of the piston (12) body (120) and at least the same number N of guide rings (1221).

13. The projectile (P) according to claim 1, wherein the projectile includes at least a fixing means, comprising at least a tenon (130) of the locking disc (13) and an abutment (122) of the pressure piston (12) for preventing the continuous rotation of at least one wing (2) or fin around the axis of rotation (ZZ') of the first deployment phase once the second deployment phase is engaged.

* * * * *